US006182702B1

(12) United States Patent
Edlund et al.

(10) Patent No.: US 6,182,702 B1
(45) Date of Patent: Feb. 6, 2001

(54) DEVICE FOR GENERATING AN UNDERPRESSURE

(75) Inventors: Stefan Edlund, Skogstorp; Serge Sochon, Stockholm; Tomas Botold, Stockholm; Jan Svensson, Stockholm, all of (SE)

(73) Assignee: AB Rexroth Mecman, Stockholm (SE)

( * ) Notice: Under 35 U.S.C. 154(b), the term of this patent shall be extended for 0 days.

(21) Appl. No.: 09/214,467

(22) PCT Filed: Jul. 3, 1997

(86) PCT No.: PCT/SE97/01210

§ 371 Date: May 6, 1999

§ 102(e) Date: May 6, 1999

(87) PCT Pub. No.: WO98/04840

PCT Pub. Date: Feb. 5, 1998

(30) Foreign Application Priority Data

Jul. 22, 1996 (SE) ..... 9602838

(51) Int. Cl.[7] ..... F15B 13/00
(52) U.S. Cl. ..... 137/884; 417/187
(58) Field of Search ..... 137/884; 417/187

(56) References Cited

U.S. PATENT DOCUMENTS 5,277,468 1/1994 Blatt et al. .
5,617,898 * 4/1997 Nagai et al. ..... 137/884

FOREIGN PATENT DOCUMENTS 0 610 501 3/1993 (EP) .
2 254 909 10/1992 (GB) .
93/05296 * 2/1993 (WO) .

* cited by examiner

*Primary Examiner*—John Fox
(74) *Attorney, Agent, or Firm*—Townsend & Townsend and Crew LLP

(57) ABSTRACT

An ejector unit (1) is mounted on a conventional valve manifold (10) with a manifold pressurised air supply connected to an ejector (4) through channels (15, 16) and a first pilot valve (3). A suction channel (20) and a return air channel (22) are connected through manifold (10) to outlet ports from the ejector (4) suction chamber (17) and outlet nozzle (18') respectively.

Figure 1:
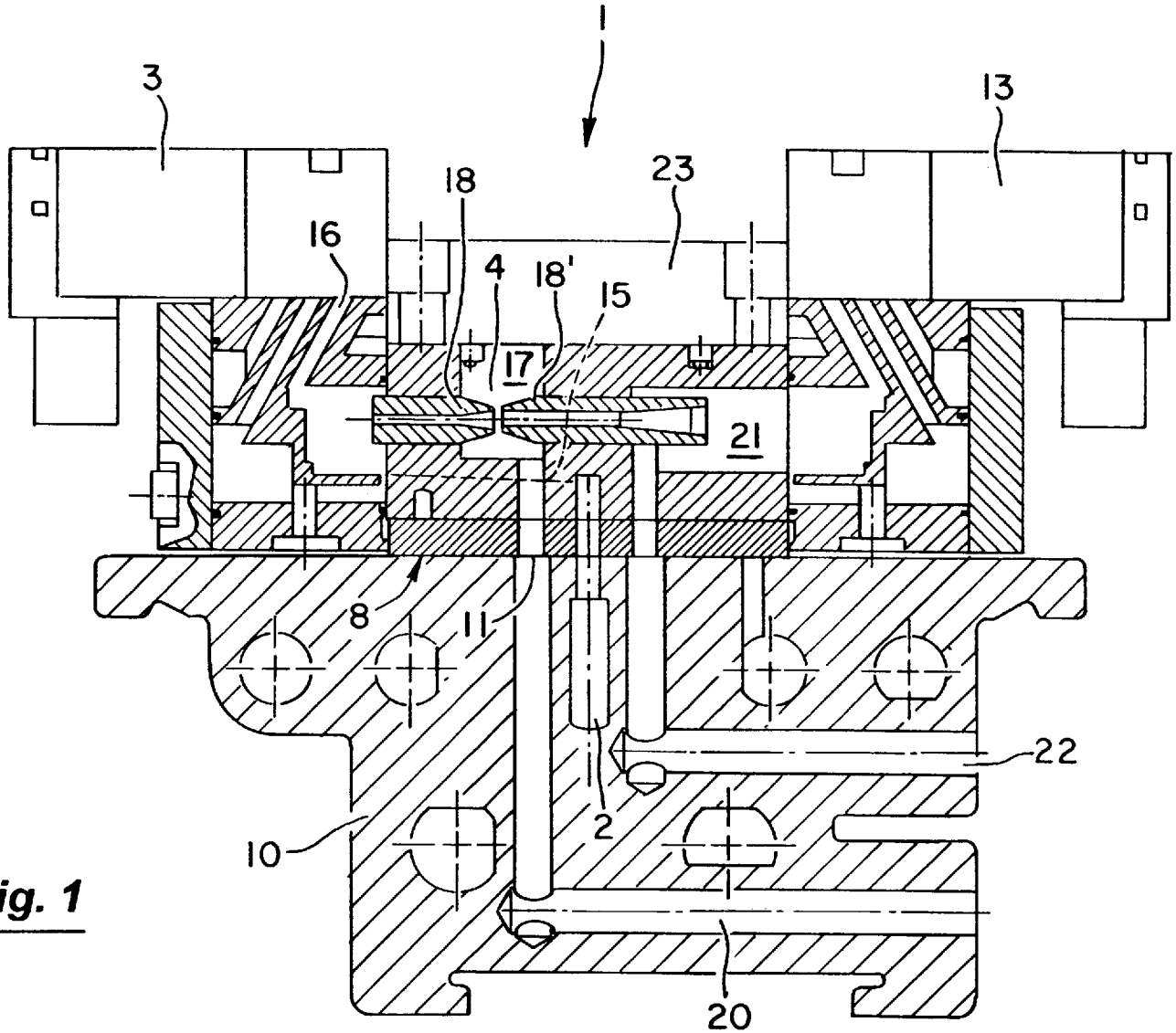

The ejector unit (1) is mounted through face (8) onto manifold (10) using the same hole pattern as for valves connected to the manifold.

4 Claims, 3 Drawing Sheets

DEVICE FOR GENERATING AN UNDERPRESSURE

This invention concerns a device for generating an underpressure (partial vacuum).

The device also concerns a manifold arrangement including such a device.

It is common today to use manifold mounted pneumatic valves for supplying cylinders and rotary actuators and other actuating motors for different kinds of apparatus. An important reason for this is that such arrangements permit the use of standard components to a high extent. Another reason is the logical and compact assembly of the valve units.

It is further previously known to use air pressure operated ejector units for different functions, such as, for example, manipulating units using an underpressure for suction cups, suction grippers or the like. Such ejector units are arranged separately and have separate conduit arrangements for air pressure, possible air return as well as for the different valve connections which result in a relatively complicated and space demanding arrangements.

GB-A-22 54 909 concerns a valve block wherein plate like units including valve functions or suction functions are stacked side by side in such a way that the units are at some extent integrated with each other. This solution however, preclude the use of the above discussed manifold arrangement of the valves and therefore does not present the advantages associated therewith.

It is an aim of this invention to avoid the problems of the prior art and to provide a less complicated, more easily used and more cost effective solution.

This way it is achieved that the ejector unit can be mounted on a conventional valve manifold. This results in equipment for different kinds of machines such as e.g. manipulators, using pressurised air for the operation of working cylinders, rotary actuators etc., as well as an underpressure for grippers etc., are supplied from one and the same valve manifold by on the one hand pressurised air regulating valves and on the other hand ejector units. This result in great advantages with respect to mounting of the ejector unit, since no separate channelling is necessary, only the connection of an underpressure conduit to the suction gripper or any other unit being operated by an underpressure. The assembly is essentially easier to understand and logical since it is easy for a user to connect the ejector unit, in principle in the same way as a valve unit is connected to the manifold. The ejector unit according to the invention thus uses the same hole pattern as the valve unit for the manifold in question which is a considerable advantage since a standard type adaptation surface may be used.

Thanks to the invention, problems of the prior art, such as separate (other) pressurising for valve operation and operation of the underpressure generator, complete channelling, often larger details and separate mounting are avoided. The ejector unit according to the invention are thus constructed to be operated by the prevailing pressure in the valve manifold. That is, a single source of pressurized air can be connected to the valve manifold resulting in the availability of both pressurized air and underpressure (partial vacuum) from the valve manifold.

By also leading the underpressure channel through the valve manifold, the construction of the ejector unit is simplified and the channelling further simplified.

By the return air channel being lead through the manifold the corresponding advantage is obtained.

By arranging a second pilot valve for generating an air pressure pulse through the underpressure channel, it is achieved in a per see known manner that the grip function or the like is safely broken at a chosen time.

The invention also concerns a manifold arrangement including a valve manifold and at least one manifold valve and one ejector unit. Such a manifold arrangement result in the above mentioned advantages in applications where pressurised air controlling valves as well as underpressure generators are necessary.

Figure 2:
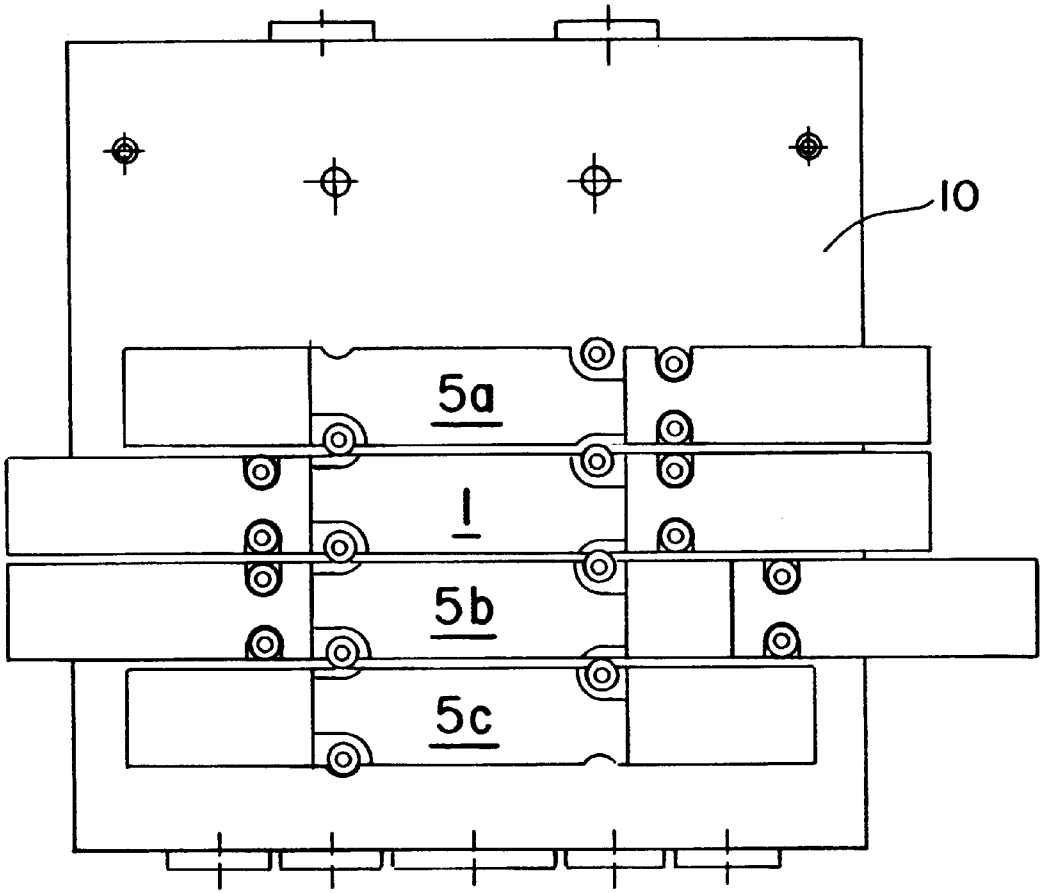
Figure 3:
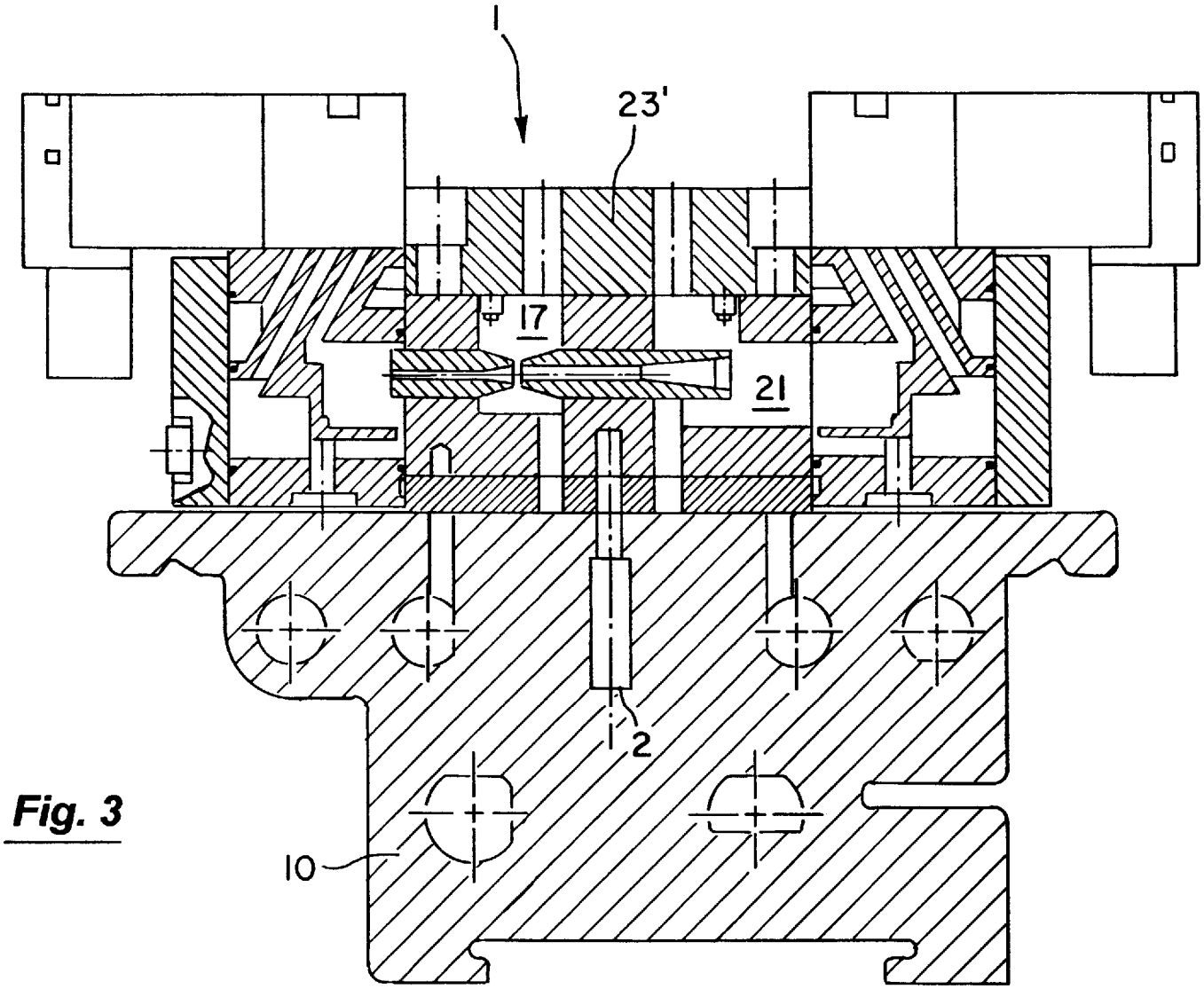

Other advantages of the invention are obtained by the further characterizing features and are clear from the following description of embodiments referring to the annexed drawings, wherein;

FIG. 1 hows a manifold mounted ejector unit according to the invention, partly in section, FIG. 2 shows a manifold arrangement including an ejector unit according to FIG. 1 in a view from above, and FIG. 3 shows an alternative ejector unit assembly.

Ejector unit 1 in FIG. 1 is connected to a pressurised air channel 2, which comprises the supply channel of a conventional valve manifold 10 which in a per see known manner is provided with several channels. A pilot valve 3 is connected to the ejector unit 1 and controls pressure fluid which from said air pressure channel 2 is lead through the ejector unit 1 as a channel (indicated with broken line at 15) over the pressurised air port of the valve manifold. A channel 16 is further leading from the pilot valve 3 to an ejector 4 which as usual comprises an inlet nozzle 18 which, when the pilot valve is actuated, is fed with pressurised air such that a thin pressurised air jet when passing into the outlet nozzle 18' of the ejector generates an underpressure in the underpressure chamber 17.

The underpressure chamber 17 is connected through a consumer port 11 to a consumer channel whereby said consumer channel 20 forms the underpressure (partial vacuum) channel of the ejector unit 1. At the side of the manifold there are connection possibilities for hoses between this underpressure channel and a suction gripper or any other equipment using an underpressure.

The lower side 8 of the ejector unit comprises an adaptation surface which over a sealing arrangement is sealingly mounted on the manifold 10 such that sealed connection is achieved between the different channels of the manifold and the channels of the ejector unit.

At the opposite side of the ejector unit with respect to the first pilot valve 3 a second pilot valve 13 is connected which is controllable so as to provide pressurised air feed, at least as a temporary pressurised air pulse, in the underpressure channel 20. The reason for this arrangement is that otherwise some types of grippers maintain a holding underpressure between at least some of its parts, for example certain flange-like protrusions, so that the gripper does not loose its grip to the gripped object at the desired time. A pressurised air pulse through the underpressure channel results in a repelling effect between the gripper and the gripped object. The outgoing channel from the second pilot valve 13 may be connected to the underpressure chamber 17.

22 indicates a return-air channel which is lead in the manifold and which is arranged to deaerate said return-air chamber 21. 23 indicates an upper cover plate for tight sealing of the ejector unit chambers.

FIG. 2 shows a manifold arrangement with a conventional manifold 10, wherein the connections are located at the upward and downwards directed ends, as seen in the Figure, whereas the consumer connections are oriented sidewards. An ejector unit 1 and three valve units **5*a*–5*c* are mounted on the manifold, each one being provided with the appropriate pilot valves. By the arrangement according to FIG. 2** three pressurised air flows and one underpressure may be controlled from one and the same manifold, which gives the above mentioned advantages with respect to channelling of signal conduits as well as fluid conduits in comparison with the conventional art.

FIG. 3 shows an alternative mounting arrangement of an ejector unit 1, wherein the upper cover plate 23' is provided with through-holes from the under-pressure chamber 17 as well as from the return-air chamber 21. This arrangement permits connections of underpressure conduits directly from the upper side of the ejector unit which may be advantageous in certain applications. The manifold may in this case be constructed without channels leading from the chamber 17 and the chamber 21.

The invention may be modified within the scope of the following claims and as an example the adaptation surface of the ejector unit may be adapted to different types of and constructions of valve manifolds. The channelling may thus be made otherwise in the ejector unit as long as the above described function is maintained.

The second pilot valve is not necessary in all applications and may therefore be left out in certain cases.

By the invention the equipment is greatlty simplified when both controlled pressurised air and underpressure is necessary for the application in question. Instead of arranging a separate ejector unit having separate channelling of fluid channels, as well as electrical or other control conduit, these functions may thus be integrated in the conventional valve manifold. Needless to say, the that pressurised air supply capacity etc. is adjusted to what is necessary for the pressurized air valves as well as for each ejector unit which is used with the valve manifold.

As an alternative the pressurised air supply for the ejector unit may be provided through a manifold channel other than channel 2. By using separate pressurized air supply channels, the valves and the ejector unit (units) may be supplied with different pressures. This may be an advantage if a high valve supply pressure but a lower ejector supply pressure (or vice versa).

It may, finally, be mentioned that the ejector unit may be constructed for tight application on the manifold either directly or indirectly over an intermediate structure, such as an adapter plate, a sealing plate or the like.

What is claimed is:

1. A pneumatic valve assembly comprising:

a valve manifold (10) defining a surface:

said manifold defining a pressurized air channel (2) fluidly coupled to a plurality of pressure ports situated along said surface;

said manifold defining a vacuum channel (20) coupling a first vacuum port (11) formed in said surface with a second vacuum port formed at other than said surface;

at least one valve unit (5) mounted to the surface in fluid communication with at least one of said pressure ports;

an ejector unit (1) mounted to the surface in fluid communication with a second of said pressure ports and with said first vacuum port;

a pilot valve (3);

said ejector unit fluidly coupling the pilot valve to said second pressure port;

said ejector unit defining a partial vacuum region (17);

said ejector unit comprising an ejector (4) fluidly coupled to the pilot valve and creating a partial vacuum at the partial vacuum region; and said ejector unit defining a fluid path coupling the partial vacuum region with said first vacuum port.

2. The assembly according to claim 1 wherein the manifold defines a return air channel (22) extending between a first return-air port at the surface and second return-air port, and wherein the ejector unit defines a return-air chamber (21) fluidly coupled to the first return-air port.

3. The assembly according to claim 2 further comprising a second pilot valve (13) fluidly coupled to the return air chamber, whereby supplying pressurized air to the return air chamber by the second pilot valve raises the pressure within the partial vacuum region and thus within the vacuum channel.

4. The assembly according to claim 1 wherein said pilot valve is an electrically-controlled pilot valve.

* * * * *